US005269281A

United States Patent [19]

Hafner

[11] Patent Number: 5,269,281

[45] Date of Patent: Dec. 14, 1993

[54] APPARATUS FOR INJECTING A FUEL-AIR MIXTURE FOR MULTI-CYLINDER INTERNAL COMBUSTION ENGINES

[75] Inventor: Udo Hafner, Ludwigsburg, Fed. Rep. of Germany

[73] Assignee: Robert Bosch GmbH, Stuttgart, Fed. Rep. of Germany

[21] Appl. No.: 842,210

[22] PCT Filed: Aug. 14, 1990

[86] PCT No.: PCT/DE90/00626

§ 371 Date: Mar. 23, 1992

§ 102(e) Date: Mar. 23, 1992

[87] PCT Pub. No.: WO91/04408

PCT Pub. Date: Apr. 4, 1991

[30] Foreign Application Priority Data

Sep. 21, 1989 [DE] Fed. Rep. of Germany ..... 3931490

[51] Int. Cl.[5] ..... F02M 67/00; F02M 69/08; F02M 69/50

[52] U.S. Cl. ..... 123/531

[58] Field of Search ..... 123/531, 533, 532, 534

[56] References Cited

U.S. PATENT DOCUMENTS 4,708,117 11/1987 Mesenich et al. ..... 123/531
4,709,681 12/1987 Rozsas ..... 123/533
4,754,740 7/1988 Emmenthal et al. ..... 123/531
4,794,901 1/1989 Hong et al. ..... 123/533

*Primary Examiner*—Andrew M. Dolinar
*Attorney, Agent, or Firm*—Edwin E. Greigg; Ronald E. Greigg

[57] ABSTRACT

An apparatus for injecting a fuel-air mixture for multi-cylinder internal combustion engines having an electromagnetically actuated fuel injection valve with a valve seat and valve member, and a distributor with an air feed and a number of distributor bores, corresponding to the number of engine cylinders, and communicating with the air feed. In order for there to be only an extremely slight variation in quantity of the fuel metered to the various distributor bores during the valve opening, while having a simple structure of the fuel injection valve, the valve member is carried by a valve needle that is axially displaceably guided in a valve chamber preceding the valve seat by means of a guide segment, the fuel being delivered to the valve chamber in a region between the valve seat and the guide segment.

20 Claims, 2 Drawing Sheets

Fig. 2
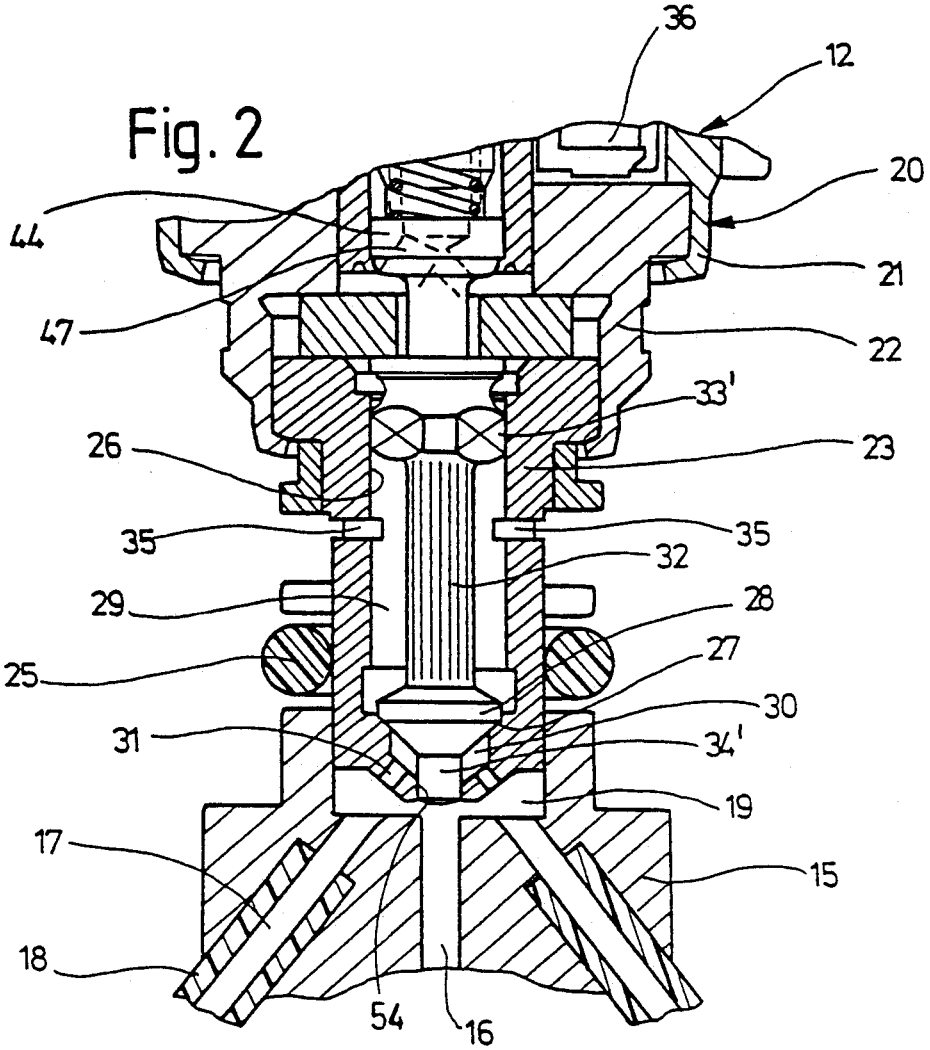
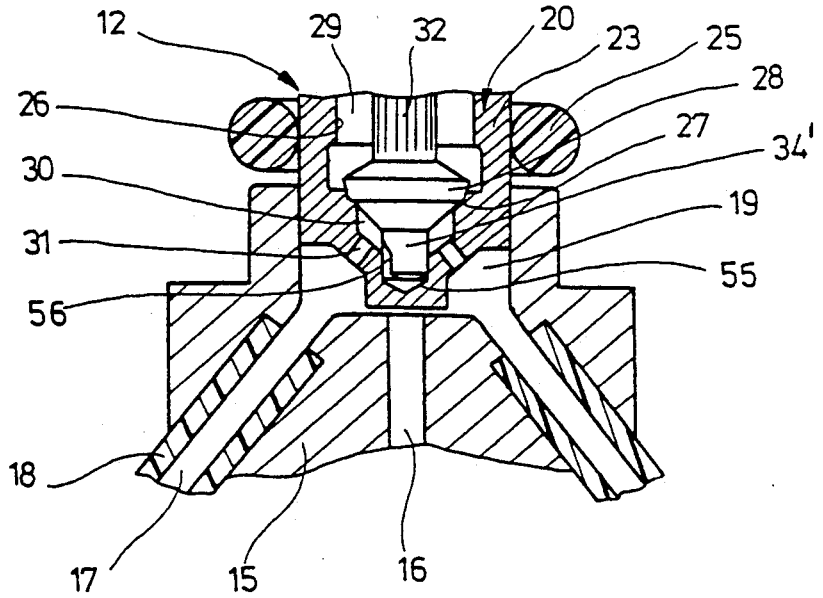
Fig. 3

APPARATUS FOR INJECTING A FUEL-AIR MIXTURE FOR MULTI-CYLINDER INTERNAL COMBUSTION ENGINES

BACKGROUND OF THE INVENTION

The invention is based on an apparatus for injecting a fuel-air mixture for multi-cylinder internal combustion engines.

In injection apparatuses of this kind, in contrast to previously conventional fuel injection devices, it is not pure fuel but rather a mixture of fuel and a supporting air flow diverted from the intake line of the engine that is brought to the injection points of the engine. The fuel-air mixture is carried to the injection points of the various cylinders of the engine via the injection lines connected to the various distributor bores. The injection point may be the intake tube, leading to each engine cylinder, of the intake line or the inlet valve of the cylinder. Mixing the fuel prior to the actual injection into the cylinder results first in better preparation of the fuel and hence more favorable combustion in the engine; second, it offers the opportunity to supply a plurality of engine cylinders while having exact metering, using only a single fuel injection valve.

In a known apparatus of the type referred to at the outset above (German Patent Disclosure Document 37 10 127 A1), the valve member is embodied on a sheath that is axially displaceably guided on a shaft and is connected to the electromagnet. The shaft has a flange on one end that rests on the distributor and has fuel metering bores that ar coaxial to the distributor bores; on the top of the flange, remote from the distributor, these bores are closed by the valve member, which is pressed onto the flange by a valve closing spring. Upstream of the flange as viewed in the fuel flow direction, there is a valve chamber receiving the valve closing spring; this chamber communicates on the one hand with the fuel inflow, via the hollow-cylindrical annular conduit, which is coaxial with the shaft, between the sheath and the electromagnet and on the other with the fuel return, via a pressure regulating valve.

Advantages of the Invention

The apparatus according to the invention has an advantage, while having a very simple structure, of meeting the requirement for an only extremely slight variation in quantity of the fuel metered to the various distributor bores. Because of the position of the fuel inlet into the valve chamber between the valve seat and the valve needle guide, a uniform oncoming flow to the various fuel metering bores, unimpeded by the valve needle motion, is attained, and as a result in turn the fuel streams flowing out of the various distributor bores differ from one another in quantity only very slightly.

The apparatus according to the invention also has the advantage that a side-feed valve known per se, as used in in-line injection pumps for each engine cylinder, can be used as the fuel injection valve with only slight structural changes. This kind of side-feed valve is described in German Patent Disclosure Document DE 37 05 848 A1, for instance. The structural changes comprise shifting the at least one connecting bore leading to the valve chamber, and embodying the distributor chamber so that the fuel metering bores are on the side of the valve seat remote from the valve chamber.

With the provisions recited herein, advantageous further features of and improvements to the apparatus disclosed are possible.

In a preferred embodiment of the invention, the valve needle, with a guide section, and the valve chamber are dimensioned such that the inside annular cross section of the valve chamber remaining between the valve needle and the inner wall of the valve chamber is 40 to 80 times greater than the annular seat cross section. Moreover, the at least one connecting bore is dimensioned such that the inside annular cross section between the valve needle and the inner wall of the valve chamber is 10 to 20 times greater than the cross section of the connecting bore. This structural dimensioning creates a compensation volume in the valve chamber between the valve needle guide segment and the valve seat, and this volume assures adequate smoothing of fuel fluctuations upstream of the valve seat. In a preferred embodiment, the cross section of the valve seat is approximately 0.3 $mm^2$.

In a further embodiment of the invention, the valve needle is provided with a second guide segment, which is formed on the free end of the valve needle remote from the first guide segment, on the far side of the valve seat. The second guide segment is located in a guide bore coaxially adjoining the distributor chamber. This second guide segment, without impairing the uniformity of fuel metering to the various distributor bores, prevents tilting of the valve needle, because the guide segments on the valve needle are located far apart. The valve needle runs smoothly and high switching speeds are made possible.

If in a further embodiment of the invention the guide bore is embodied as a through bore, then the play between the through bore and the valve needle guide segment located in it must meet very close tolerances; otherwise, in the event of long injection pulses, the existing system pressure would cause fuel to escape through the guide gap into the air feed.

For the sake of lowering the necessary precision in guide bore production, the guide bore is embodied as a blind bore in a preferred exemplary embodiment of the invention. The valve needle guide segment located in the guide bore is provided with an axial venting groove, which enables equalizing the pressure in the guide bore.

DRAWING

The invention is described in further detail in the ensuing description, in terms of exemplary embodiments shown in the drawing. Shown are:

FIG. 1, in fragmentary form, a longitudinal section through an apparatus for injecting a fuel-air mixture for a multi-cylinder internal combustion engine;

FIGS. 2 and 3, each in fragmentary form, a longitudinal section through the injection apparatus in accordance with second and third exemplary embodiments.

DESCRIPTION OF THE EXEMPLARY EMBODIMENTS

Figure 1:
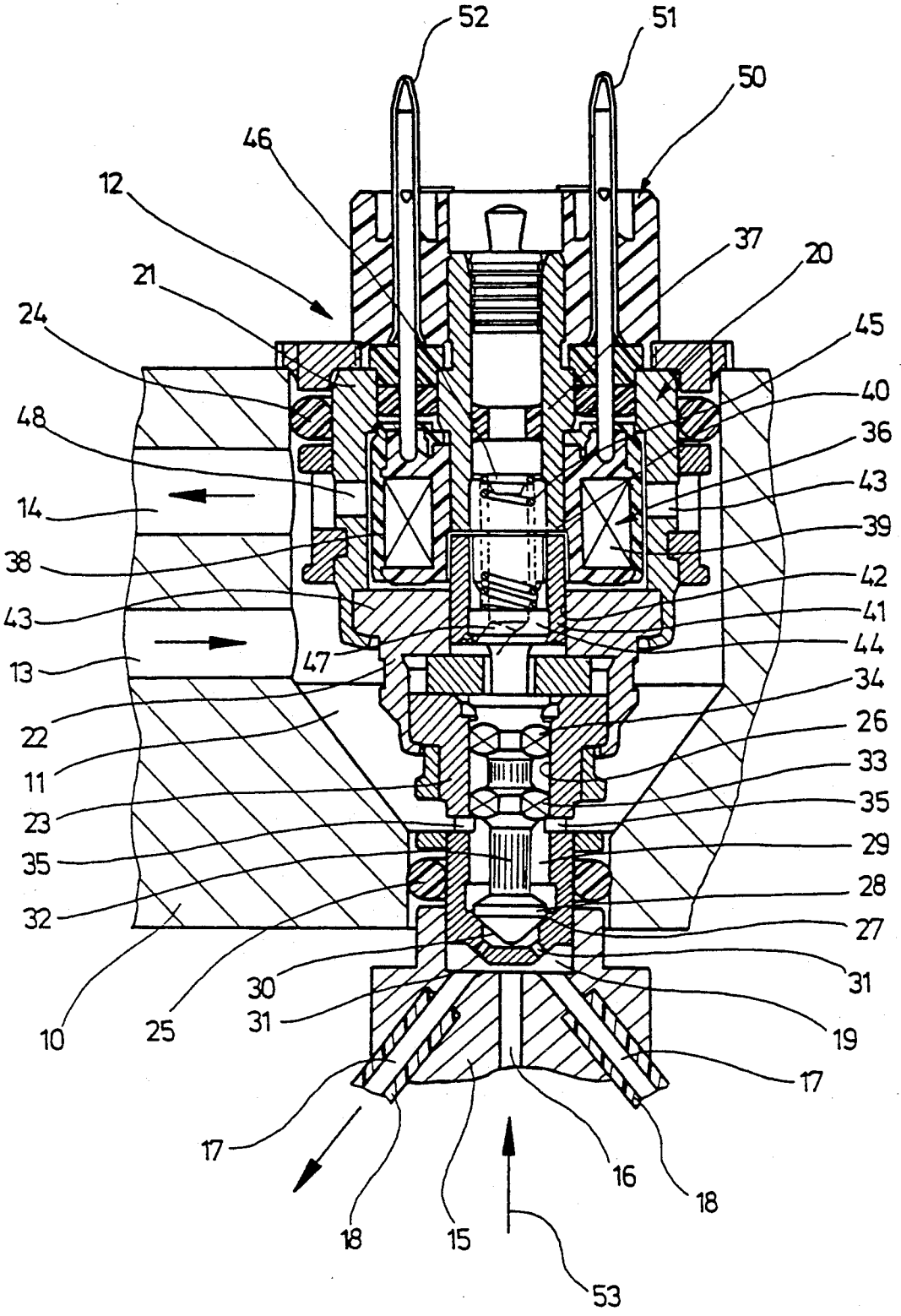

The apparatus, shown in longitudinal section and in fragmentary form in FIG. 1, for injecting a fuel-air mixture for a multi-cylinder internal combustion engine has a fuel injection valve 12, which is inserted in a fluid-tight manner into a receiving chamber 11 of a valve holder 10. The receiving chamber 11 is connected to a fuel inlet 13 and to a fuel return 14. The fuel flow direction is represented by arrows. The injection apparatus also includes a distributor 15, mounted on the outlet side of the fuel injection valve 12 and having an air feed 16 and a plurality of distributor bores 17 communicating with the air feed 16. The number of distributor bores 17 matches the number of cylinders of the engine. From each of the distributor bores 17, a respective injection line 18 leads to each engine cylinder and discharges in the cylinder intake tube.

The fuel injection valve 12 has a three-part valve housing 20 with a cup-shaped top part 21, a middle part 22, and a neck-like bottom part 23. The middle part 22 is inserted into the top part 21, and the bottom part 23 is inserted into the middle part 22, and each is secured by being crimped around the periphery. The top part 21 is sealed off from the inner wall of the receiving chamber 11 with a sealing ring 24, and the bottom part 23 is likewise sealed off with a sealing ring 25. The receiving chamber 11 enclosed between the sealing rings 24, 25 is filled with fuel, so that the valve housing 20 has a flow of fuel around it. A stepped bore 26 closed on the end is provided in the neck-like bottom part 23, and a valve seat 27 is formed in this bore at the transition between two bore segments. The valve seat 27, cooperating with a valve member 28, divides the stepped bore 26 into a preceding valve chamber 29 and a succeeding distributor chamber 30. Fuel metering bores 31 that pierce the wall of the bottom part 23 discharge into the distributor chamber 30. The free end of the bottom part 23 protrudes into a recess 19 in the distributor 15; both the air feed 16 and the distributor bores 17 discharge into this recess. The disposition of the fuel metering bores 31 is such that they are each aligned substantially coaxially with a respective associated distributor bore 17.

The valve member 28 is embodied on a valve needle 32, which is guided axially displaceably in the valve chamber 29 by means of two guide segments 33, 34 of larger diameter. Via radial bores 35, two of which can be seen in FIG. 1, the valve chamber 29 communicates with the fuel-filled receiving chamber 11. The radial bores 35 are made in such a way that they discharge in the valve chamber 29 in the region between the valve seat 27 and the next closest guide segment 33 to the valve seat 27. The radial bores 35 are dimensioned such that the inside annular cross section of the valve chamber 29 that remains between the valve needle 32 and the inner wall of the stepped bore 26 is approximately 10 to 20 times greater than the sum of the cross sections of the radial bores 35. Moreover, the valve needle 32 with its guide segments 33, 34 and the valve chamber 29 in the region between the valve seat 27 and the guide segment 33 oriented toward it are embodied such that the inside annular cross section remaining between the valve needle 29 and the inner wall of the stepped bore 26 is approximately 40 to 80 times larger than the annular cross section of the valve seat 27. The latter is preferably selected to be approximately 0.3 $mm^2$. By means of this dimensioning, there is a compensation volume of fuel, located in the valve chamber 29 between the valve seat 27 and the guide segment 33 oriented toward it, that is sufficient to smooth fluctuations, so that when the valve member 28 has been lifted from the valve seat 27, uniform impingement on all the fuel metering bores 31 is assured. Because of the disposition of the radial bores 35 in the region between the valve seat 27 and the guide segment 33, the valve needle motion upon opening of the fuel injection valve causes no additional fluctuations in the compensation volume, thereby not impeding the uniformity of the oncoming flow to the fuel metering bores 31.

The valve needle 32 is actuated by an electromagnet 36 accommodated in the top part 21 of the valve housing 20. The magnet cup of the electromagnet 36 is formed by the top part 21 of the housing, which has an integral coaxial hollow-cylindrical magnet core 37, which extends past the cup bottom to the outside in the manner of a neck. A coil holder 38, on which an exciter coil 39 is wound, is seated in a known manner on the magnet core 37. A magnet armature 41 disposed coaxially with the magnet core 37 and located opposite it, leaving an operating air gap 40, is guided axially displaceably in a bore 42 in the middle part 22 of the housing. The middle part 22, which with a flange 43 covers the coil holder 38 and partly fits over the face end of the top part 21 of the housing, forms the shortcircuit yoke of the electromagnet 36. The end of the valve needle 32 that is provided with a flange 44 is firmly connected to the hollow-cylindrical magnet armature 41. A valve closing spring 45 disposed in the interior of the magnet core 37 and magnet armature 41 is supported at one end on the flange 44 of the valve needle 32 and at the other on an adjustable stop 46 that is screwed into the magnet core 37. Via a bore 47 in the flange 4 of the valve needle 32, the valve chamber 29 communicates with the interior of the magnet core 37, which in turn communicates via bores 48 with the receiving chamber 11. The electromagnet 36 is triggerable via a plug 50 having two contact prongs 51, 52 leading to the exciter coil 39; on being triggered, it lifts the valve needle 32 counter to the force of the valve closing spring 45, so that the valve member 28 is lifted from the valve seat 27 for the duration of magnet excitation. The fuel, which is under pressure in the valve chamber 29, is injected via the fuel metering bores 31 into the distributor bores 17, where it mixes with the supporting air flow (arrow 53) delivered via the air feed 16, and this flow is distributed uniformly via the recess 19 to the various distributor bores 17.

In the injection apparatus according to a further exemplary embodiment, shown in fragmentary longitudinal section in FIG. 2, only the fuel injection valve 12 has been modified, with respect to the guidance of the valve needle 32. The second guide segment 34 of the valve needle 32 has been removed from the valve chamber 29 and shifted to the far side of the valve seat 27 and embodied on the free end of the valve needle 32 in the form of a guide segment 34'. A through bore 54, which connects the valve chamber 29 with the recess 19 in the distributor 15, is made in the otherwise blind bottom of the stepped bore 26. The guide segment 34' is guided axially displaceably, with a very close-tolerance play, in this through bore 54. The first guide segment 33' remaining the valve chamber 29, near the valve seat 27, is shifted on the valve needle 32 farther toward the electromagnet 36 compared with the embodiment of FIG. 1, so that there is a relatively wide spacing between the two guide segments 33' and 34'. This wide spacing prevents tilting of the valve needle 32, so that it cannot become canted and it runs very smoothly, which makes short switching times of the valve possible.

The injection apparatus shown in fragmentary form in FIG. 3 as a further exemplary embodiment differs from that of FIG. 2 solely in terms of the embodiment of the guide bore for the guide segment 34' at the end of the valve needle 32. Here, for guiding the guide segment 34', a blind bore 55 is provided on the bottom of the stepped bore 26; the blind bore receives the guide segment 34' on the valve needle 32 with play. For equalizing pressure in the blind bore 55 during the valve needle motion, the guide segment 34' has a longitudinally continuous axial venting groove 56 on its surface.

The foregoing relates to a preferred exemplary embodiment of the invention, it being understood that other variants and embodiments thereof are possible within the spirit and scope of the invention, the latter being defined by the appended claims.

I claim:

1. An apparatus for injecting a fuel-air mixture for multi-cylinder internal combustion engines, having a fuel injection valve (12), a valve housing (20) connected to a fuel inlet (13) and to a fuel return (14) said valve housing (20) is inserted in a fluid-tight manner into a receiving chamber (11) that communicates with the fuel inlet (13) and return (14) and includes a valve seat (27), embodied as an annular shoulder; a valve chamber (29) disposed upstream of the valve seat (27) in a fuel flow direction; a valve member (28) that cooperates with the valve seat (27); an electromagnet (36) for actuating the valve member (28); an elongated valve needle component (32) that carries the valve member (28), which valve needle component is guided axially displaceably in the valve chamber (29) by means of at least one guide segment (33; 33') embodied spaced apart from the valve seat (27) and is connected to a magnet armature (41), and has at least one connecting bore (35) connecting the valve chamber (29) to the fuel inlet (13) said at least one connecting bore is embodied as a radial bore (35) which extends from an outer wall of the valve housing (20) to said valve chamber (29); a fuel distributor (15), which has an air feed (16) and a number, corresponding to the number of engine cylinders, of distributor bores (17) that communicates with an air feed (16), which are connected to the fuel injection valve (12) via fuel metering bores (31) made coaxially to them in the valve housing (20), the valve seat (27) is embodied in a housing bore (26); that the valve seat (27) divides the housing bore (27) into the preceding valve chamber (29) and a distributor chamber (30), succeeding the valve seat (27) in the flow direction, into which distributor chamber the fuel metering bores (31) discharge; and that the at least one connecting bore (35) discharges into the valve chamber (29) in a region between the valve seat (27) and the at least one guide segment (33; 33').

2. An apparatus as defined by claim 1, in which the valve needle (32) with its guide segment (33; 33') and the valve chamber (29) are embodied such that the inside annular cross section of the valve chamber (29) remaining between the valve needle (32) and the inner wall of the housing bore (26) is approximately 40 to 80 times larger than a cross section of the valve seat (27).

3. An apparatus as defined by claim 2, in which the valve needle (32) has a second guide segment (34'), which is embodied on a free end of the valve needle (32) remote from the first guide segment (33') and rests in a guide bore (54, 55) coaxially adjoining the distributor chamber (30).

4. An apparatus as defined by claim 3, in which the guide bore is embodied as a through bore (54), which connects the distributor chamber (30) to the air feed (16), and that a play between the guide segment (34') and the through bore (54) is kept to a very close tolerance.

5. An apparatus as defined by claim 4, in which the guide bore is embodied as a blind bore (55), and the guide segment (34') has a longitudinally continuous axial venting groove (56) on an outer jacket.

6. An apparatus as defined by claim 1, in which the at least one connecting bore (35) is dimensioned such that an annular cross section of the valve chamber (29) between the valve needle (32) and the inner wall of the housing bore (26) is approximately 10 to 20 times greater than a cross section of each of the at least one connecting bore (35).

7. An apparatus as defined by claim 6, in which the valve needle (32) has a second guide segment (34'), which is embodied on a free end of the valve needle (32) remote from the first guide segment (33') and rests in a guide bore (54, 55) coaxially adjoining the distributor chamber (30).

8. An apparatus as defined by claim 7, in which the guide bore is embodied as a through bore (54), which connects the distributor chamber (30) to the air feed (16), and that a play between the guide segment (34') and the through bore (54) is kept to a very close tolerance.

9. An apparatus as defined by claim 8, in which the guide bore is embodied as a blind bore (55), and the guide segment (34') has a longitudinally continuous axial venting groove (56) on an outer jacket.

10. An apparatus as defined by claim 1, in which the valve needle (32) has a second guide segment (34'), which is embodied on a free end of the valve needle (32) remote from the first guide segment (33') and rests in a guide bore (54, 55) coaxially adjoining the distributor chamber (30).

11. An apparatus as defined by claim 10, in which the guide bore is embodied as a through bore (54), which connects the distributor chamber (30) to the air feed (16), and that a play between the guide segment (34') and the through bore (54) is kept to a very close tolerance.

12. An apparatus as defined by claim 11, in which the guide bore is embodied as a blind bore (55), and the guide segment (34') has a longitudinally continuous axial venting groove (56) on an outer jacket.

13. An apparatus for injecting a fuel-air mixture for multi-cylinder internal combustion engines, having a fuel injection valve (12), a valve housing (20) connected to a fuel inlet (13) and to a fuel return (14) said housing including a valve seat (27), embodied as an annular shoulder; a valve chamber (29) disposed upstream of the valve seat (27) in a fuel flow direction; a valve member (28) that cooperates with the valve seat (27); an electromagnet (36) for actuating the valve member (28); an elongated valve needle component (32) that carries the valve member (28), which valve needle component is guided axially displaceably in the valve chamber (29) by means of at least one guide segment (33; 33') embodied spaced apart from the valve seat (27) and is connected to a magnet armature (41), and has at least one connecting bore (35) connecting the valve chamber (29) to the fuel in let (13); said valve needle (32) with its at least one guide segment (33; 33') and the valve chamber (29) are embodied such that an inside annular cross section of the valve chamber (29) remaining between the valve needle (32) and an inner wall of the housing bore (26) is approximately 40 to 80 times larger than a cross section of the valve seat (27) a fuel distributor (15), which has an air feed (16) and a number, corresponding to the number of engine cylinders, of distributor bores (17) that communicates with an air feed (16), which are connected to the fuel injection valve (12) via fuel metering bores (31) made coaxially to them in the valve housing (20), the valve seat (27) is embodied in a housing bore (26); that the valve seat (27) divides the housing bore (27) into the preceding valve chamber (29) and a distributor chamber (30), succeeding the valve seat (27) in the flow direction, into which distributor chamber the fuel metering bores (31) discharge; and that the at least one connecting bore (35) discharges into the valve chamber (29) in a region between the valve seat (27) and the guide segment (33; 33').

14. An apparatus as defined by claim 13, in which the at least one connecting bore (35) is dimensioned such that an annular cross section of the valve chamber (29) between the valve needle (32) and the inner wall of the housing bore (26) is approximately 10 to 20 times greater than a cross section of each of the at least one connecting bore (35).

15. An apparatus as defined by claim 13, in which the valve needle (32) has a second guide segment (34'), which is embodied on a free end of the valve needle (32) remote from the first guide segment (33') and rests in a guide bore (54, 55) coaxially adjoining the distributor chamber (30).

16. An apparatus as defined by claim 15, in which the guide bore is embodied as a through bore (54), which connects the distributor chamber (30) to the air feed (16), and that a play between the guide segment (34') and the through bore (54) is kept to a very close tolerance.

17. An apparatus as defined by claim 16, in which the guide bore is embodied as a blind bore (55), and the guide segment (34') has a longitudinally continuous axial venting groove (56) on an outer jacket.

18. An apparatus for injecting a fuel-air mixture for multi-cylinder internal combustion engines, having a fuel injection valve (12), a valve housing (20) connected to a fuel inlet (13) and to a fuel return (14) said housing including a valve seat (27), embodied as an annular shoulder; a valve chamber (29) disposed upstream of the valve seat (27) in a fuel flow direction; a valve member (28) that cooperates with the valve seat (27); an electromagnet (36) for actuating the valve member (28); an elongated valve needle component (32) that carries the valve member (28), which valve needle component is guided axially displaceably in the valve chamber (29) by means of a first guide segment (33') embodied spaced apart from the valve seat (27) and is connected to a magnet armature (41), and has at least one connecting bore (35) connecting the valve chamber (29) to the fuel inlet (13); a fuel distributor (15), which has an air feed (16) and a number, corresponding to the number of engine cylinders, of distributor bores (17) that communicates with an air feed (16), which are connected to the fuel injection valve (12) via fuel metering bores (31) made coaxially to them in the valve housing (20), the valve seat (27) is embodied in a housing which distributor chamber the fuel metering bores (31) discharge; and that the at least one connecting bore (35) discharges into the valve chamber (29) in a region between the valve seat (27) and the guide segment (33; 33'), and the valve needle component (32) has a second guide segment (34'), which is embodied on a free end of the valve needle (32) remote from the first guide segment (33') and rests in a guide bore (54, 55) coaxially adjoining the distributor chamber (30).

19. An apparatus as defined by claim 18, in which the guide bore is embodied as a through bore (54), which connects the distributor chamber (30) to the air feed (16), and that a play between the guide segment (34') and the through bore (54) is kept to a very close tolerance.

20. An apparatus as defined by claim 18, in which the guide bore is embodied as a blind bore (55), and the guide segment (34') has a longitudinally continuous axial venting groove (56) on an outer jacket.

* * * * *